US008336164B2

(12) United States Patent
Coleman et al.

(10) Patent No.: US 8,336,164 B2
(45) Date of Patent: Dec. 25, 2012

(54) UPRIGHT CLEANING APPLIANCE

(75) Inventors: James Martin Coleman, Malmesbury (GB); James John Bryden, Malmesbury (GB); Adam James Bates, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 12/903,413

(22) Filed: Oct. 13, 2010

(65) Prior Publication Data

US 2011/0088213 A1 Apr. 21, 2011

(30) Foreign Application Priority Data

Oct. 15, 2009 (GB) ..... 0918037.3

(51) Int. Cl.
*A47L 9/00* (2006.01)

(52) U.S. Cl. ..... 15/410; 15/411

(58) Field of Classification Search ..... 15/410, 15/411; *A47L 9/00*
See application file for complete search history.

(56) References Cited

U.S. PATENT DOCUMENTS

| | | | |
|---|---|---|---|
| 5,016,315 | A | 5/1991 | Bledsoe et al. |
| 6,526,623 | B1 | 3/2003 | Dyson |
| D553,814 | S | 10/2007 | Parr et al. |

FOREIGN PATENT DOCUMENTS

| | | |
|---|---|---|
| CN | 100464686 | 3/2009 |
| EP | 1 526 796 | 12/2008 |
| GB | 2 391 459 | 2/2004 |
| GB | 2 416 483 | 2/2006 |
| GB | 2 447 995 | 10/2008 |
| GB | 2 448 745 | 10/2008 |

OTHER PUBLICATIONS

GB Search Report issued Jan. 19, 2010 in counterpart GB Patent Application No. 0918037.3 (1 page).

*Primary Examiner* — David Redding
(74) *Attorney, Agent, or Firm* — Morrison & Foerster LLP

(57) ABSTRACT

An upright cleaning appliance having a handle for maneuvering the appliance across a floor. The handle is secured on a reclining upright body of the appliance for rotation about a longitudinal axis of the upright body. The handle includes a forward-extending handgrip portion which terminates in an abutment flange for preventing the handgrip portion from slipping out through the bottom of a user's grip.

9 Claims, 18 Drawing Sheets

PRIOR ART

PRIOR ART

UPRIGHT CLEANING APPLIANCE

REFERENCE TO RELATED APPLICATIONS

This application claims the priority of UK Patent Application No. 0918037.3, filed 15 Oct. 2009, the entire contents of which are incorporated herein by reference.

FIELD OF THE INVENTION

The present invention relates generally to an upright cleaning appliance, and more particularly to a handle on an upright cleaning appliance, used to maneuver the appliance across a floor surface. The invention is particularly applicable to an upright vacuum cleaner, but may also be used on other upright cleaning appliances including, for example, wet floor cleaners and floor polishers.

BACKGROUND OF THE INVENTION

A typical so-called "upright" vacuum cleaner comprises a wheeled head assembly, which carries a fixed cleaner head, and an 'upright' body which can be reclined relative to the cleaner head and which includes a handle for maneuvering the vacuum cleaner across the floor. In use, a user grasps the handle and reclines the upright body until the handle is disposed at a convenient height for the user; the user can then roll the vacuum cleaner across the floor using the handle in order to pick up dust and other debris on the floor. The dust and debris is drawn in through a downward-facing suction inlet on the cleaner head by a motor-driven fan housed on-board the vacuum cleaner. From here, the dirt-laden air stream is then ducted under the fan-generated suction pressure to some sort of separating apparatus on board the vacuum cleaner, where dirt is separated from the air before the relatively clean air is then expelled back to the atmosphere. The separating apparatus may include a bag or cyclone, and may also include one or more filters for filtering very fine particulates from the air stream.

Historically, upright vacuum cleaners were maneuvered across the floor by sequentially pushing and pulling the cleaner in straight lines, and the handle thus served primarily as a "push-pull" handle. Many upright vacuum cleaners are still maneuvered in this push-pull manner, and examples of typical push-pull handles are shown in GB200710018A, U.S. Pat. Nos. 5,016,315A, 6,526,623B, U.S. D553814S, CN100464686C and GB2448745A. The first three of these examples each show a forwardly-extending handle; the remaining three examples each show a rearwardly-extending handle.

More recently, handles on upright vacuum cleaners are being configured to rotate from side-to-side about the longitudinal axis of the upright body in order to provide some additional functionality for the cleaner. An example of this is shown in EP1 526796, where the handle of the cleaner forms part of a steering mechanism for improving maneuverability of the cleaner; here, both the upright body and the handle are co-rotatable from side to side about the longitudinal axis of the upright body as the cleaner is being pushed or pulled, in order to point the cleaner head in a desired direction and thus steer the vacuum cleaner across the floor.

SUMMARY OF THE INVENTION

Trials have revealed that traditional push-pull handle designs can be uncomfortable for certain users if the handle is intended to be rotated from side-to-side about the longitudinal axis of the upright body.

It is an object of the present invention to seek to provide a better handle for an upright cleaning appliance of the type in which the handle is required to rotate about a longitudinal axis of the upright body of the appliance, for example as part of a steering mechanism for the appliance.

According to the present invention there is provided an upright cleaning appliance having a handle for maneuvering the appliance across a floor, the handle being secured on a reclining upright body of the appliance for rotation about a longitudinal axis of the upright body, the handle comprising a forward-extending handgrip portion which terminates in an abutment flange.

The provision of an abutment flange advantageously prevents (or at least significantly reduces the chances of) the forward-extending hand grip portion from slipping down through the bottom of a user's grip, for example under the weight of the reclining upright body. The abutment flange has also been found to provide an effective "torque-bearing" surface for the top of the user's grip, which the user can utilize to increase leverage of the handle about the longitudinal axis of the upright body simply by butting his or her grip up against the underside of the flange as he or she rotates the handle. At the same time, the forward-extending hand grip portion nevertheless allows the user conveniently to rotate the handle about the longitudinal axis of the upright body. The abutment flange preferably extends perpendicular to the handgrip portion.

The handgrip portion is preferably straight. This has been found to provide better leverage for the user when rotating the handle 9 about the longitudinal axis of the upright body, particularly compared to the conventional, curved handgrip portion commonly provided on upright vacuum cleaners, where the tendency is for the user's hand to roll "over the top" of the curved handgrip portion as the handle is rotated about a longitudinal axis of the upright body of the cleaner.

The cross-sectional profile of the handgrip portion may be a racetrack profile. A racetrack-profile has been found to be particularly comfortable for the user, especially when combined with a straight handgrip portion and abutment flange.

The handgrip portion may be angled at 70-80 degrees to the longitudinal axis of the upright body. An angle in the range of 70-80 degrees has been found to be particularly comfortable for a user, and especially comfortable when combined with a straight hand grip portion, abutment flange and racetrack profile for the handgrip portion. The optimal angle for comfort has been found to be 75 degrees.

The handle may incorporate a bracing strut connecting the abutment flange to the base of the handle in order to brace the handgrip portion to the base of the handle and increase the rigidity of the handle.

The handle is particularly suited to applications where the handle forms part of a steering mechanism for steering the cleaner across the floor, the handle being connected to an intermediate part of the steering mechanism operable for co-rotation with the handle about said longitudinal axis of the upright body.

A handle incorporating all of the above features has in particular been found to be surprisingly comfortable for use in those upright cleaning appliances where the handle is typically mounted for rotation about a longitudinal axis of the upright body of the appliance.

BRIEF DESCRIPTION OF THE DRAWINGS

One or more embodiments of the invention will now be described, by way of example, with reference to the accompanying drawings, in which.

DETAILED DESCRIPTION OF THE INVENTION

Figure 1:
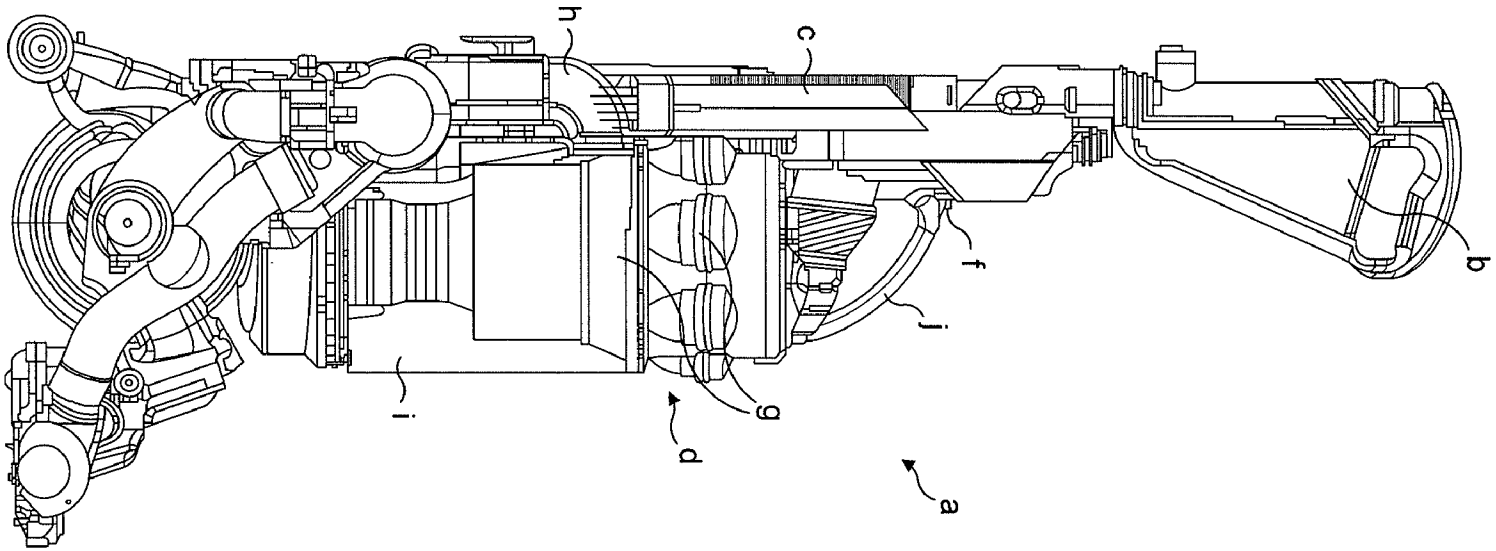
FIG. 1 is a side view showing a conventional upright vacuum cleaner.
Figure 2:
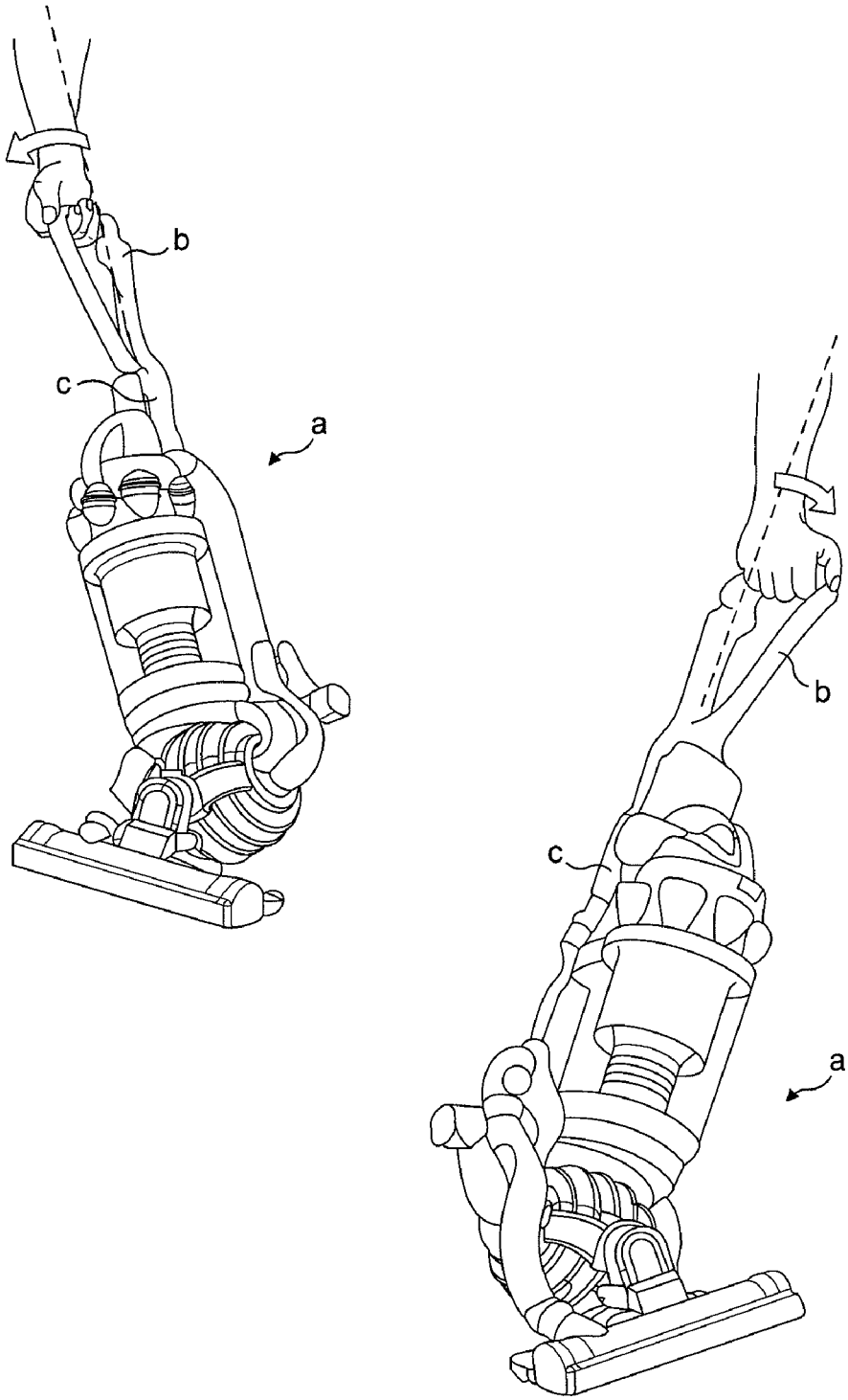
FIG. 2 is a perspective view illustrating the conventional upright vacuum cleaner of FIG. 1 being steered to the left and right across a floor.
Figure 3:
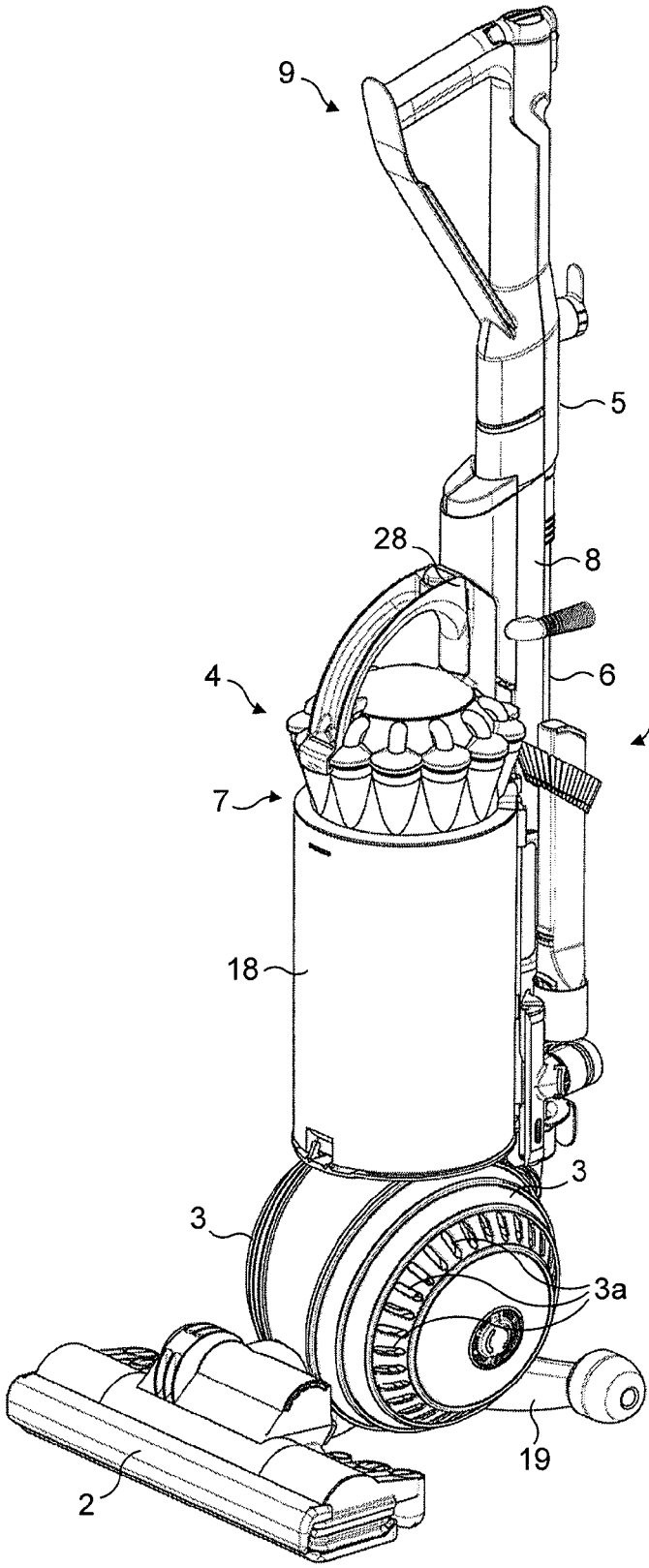
FIG. 3 is a perspective of an upright vacuum cleaner according to the present invention.
Figure 4:
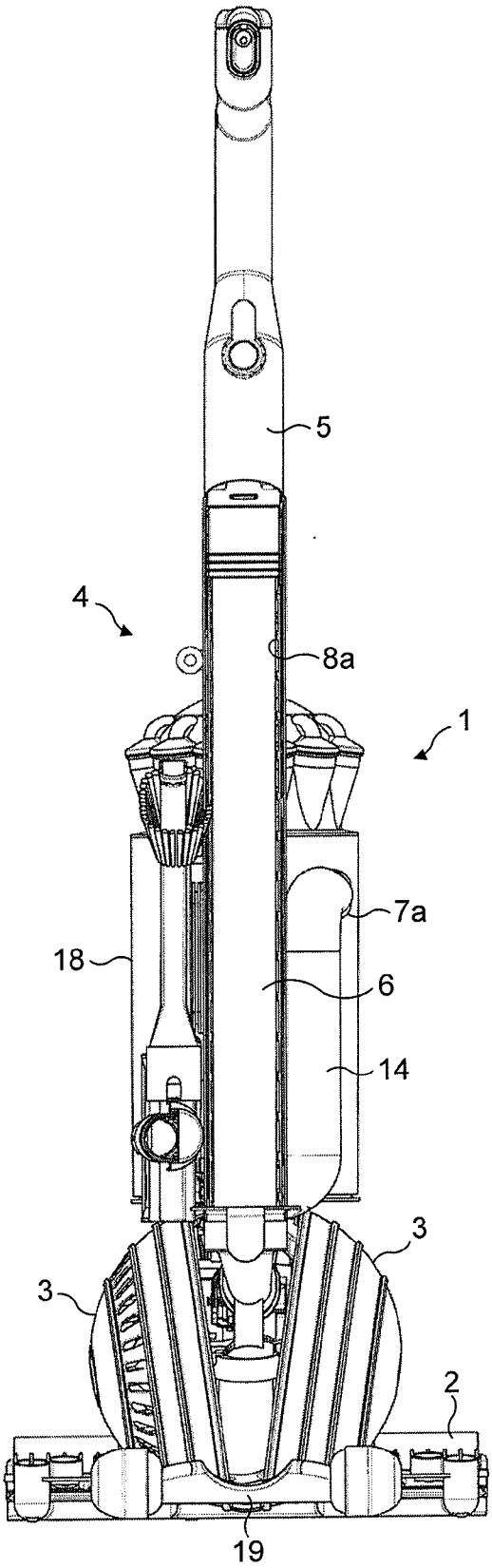
FIG. 4 is a rear view of the upright vacuum cleaner shown in FIG. 3.
Figure 5:
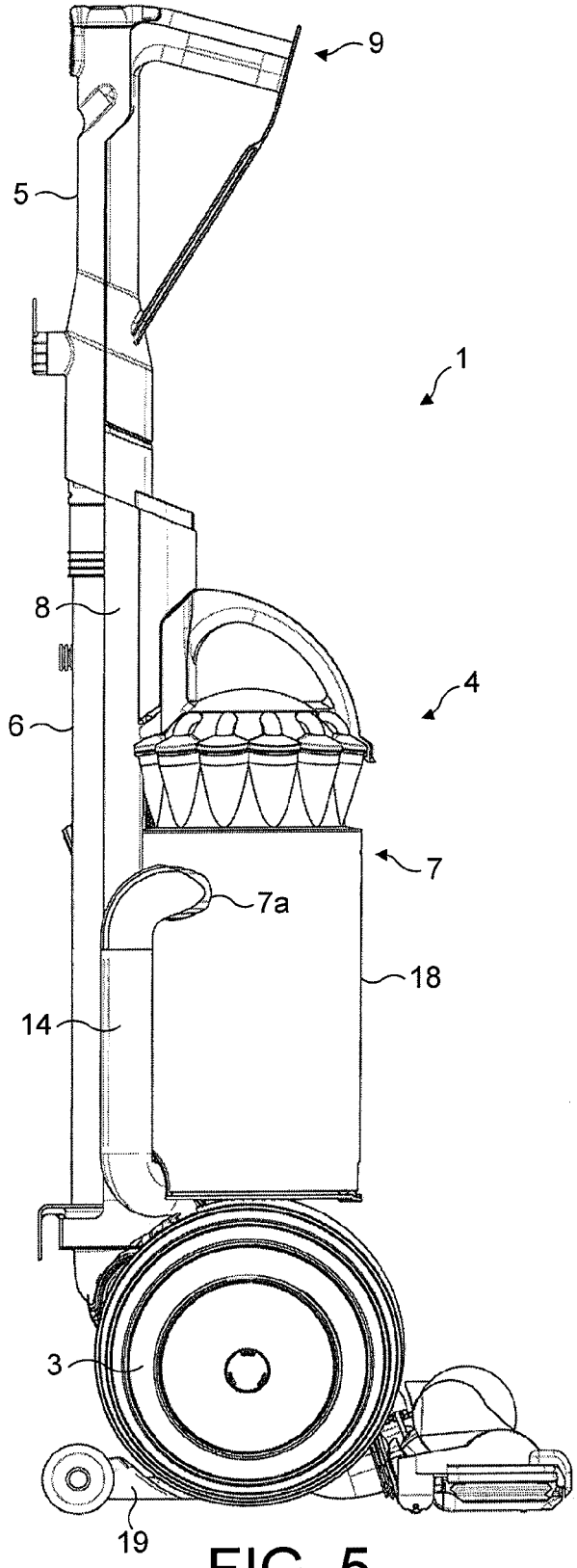
FIG. 5 is a side view of the upright vacuum cleaner shown in FIG. 3.

Referring to FIGS. 3 to 5, an upright vacuum cleaner 1 comprises a cleaner head 2 incorporating a downward-facing suction inlet (not shown); a pair of relatively large, dome-shaped wheels 3 mounted immediately behind the cleaner head 2; an upright body 4, and a suction wand 5 which is connected to a suction inlet on the upright body 4 by a flexible stretch hose 6.

The upright body 4 includes a motor-driven fan (not shown) for generating a suction pressure at the suction inlets and separating apparatus in the form of a cyclone pack 7, which is located downstream of the suction inlets for separating and depositing dust from a dust-laden air-flow drawn into the cleaner 1 by the motor-driven fan. The cyclone pack 7 is releasably secured at the front of a spine 8 which runs up the rear of the upright body 4, and a handle 9 is supported at the upper end of the spine 8.

In FIGS. 3 to 5, the wand 5 is shown in a stowed position. In this position, the hose 6 is fully retracted and the wand 5 is, in turn, retracted telescopically inside the hose 6 (see FIG. 6). Both the wand 5 and the hose 6 sit along a relatively deep recess 8*a* running up the rear of the spine 8 and continuing up the rear of the handle 9. In use, the wand 5 can be manually released from the stowed position and telescopically extended from inside the hose 6 until it is fully extended, as shown in FIG. 7. A releasable catch (not shown) is provided automatically to lock the wand 5 in this fully extended position. Following release of the wand 5, the handle 9 remains secured to the rest of the upright body 4 by the spine 8.

Figure 8:
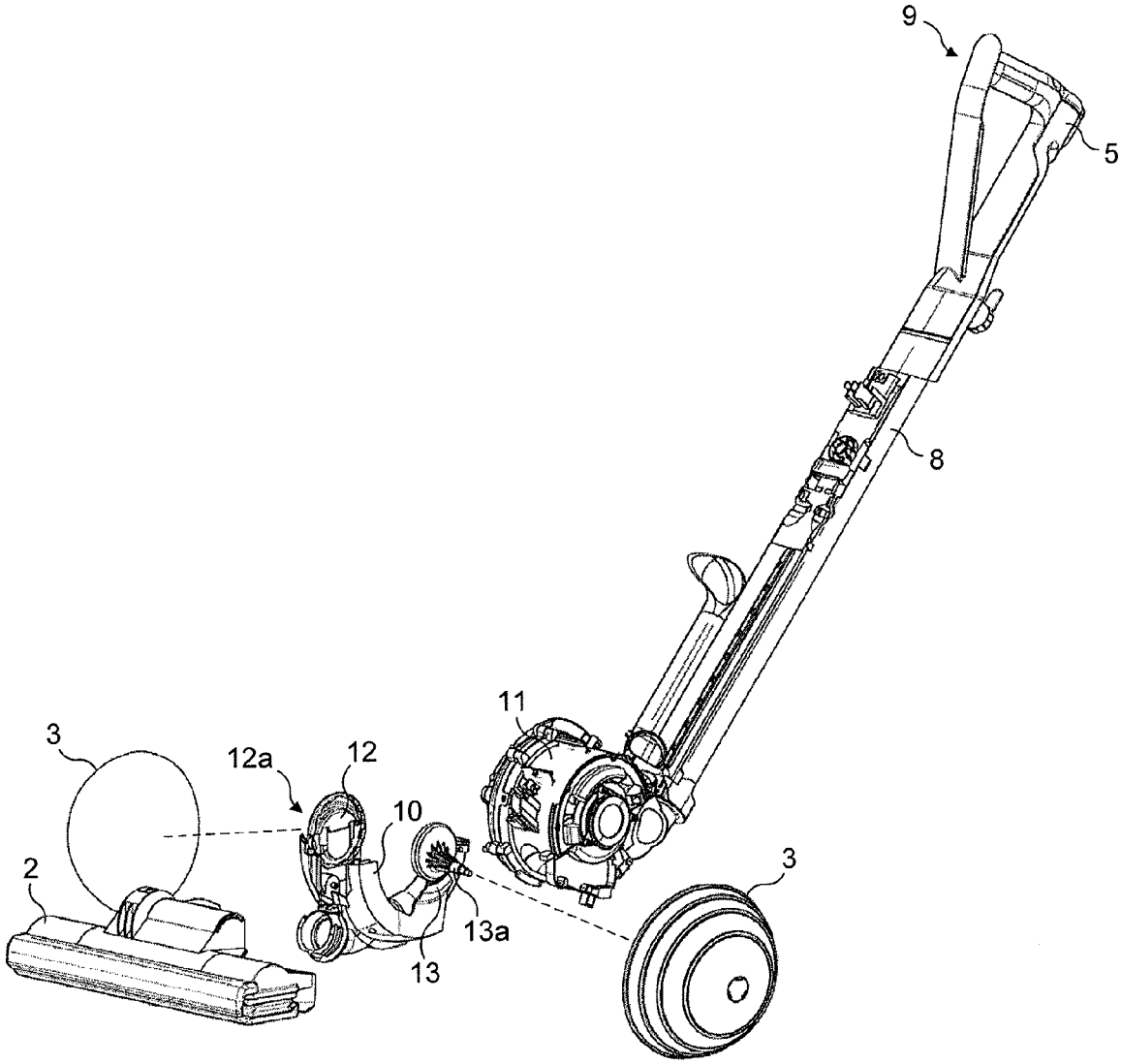
FIG. 8 is an exploded view of several parts of the cleaner shown in FIG. 3, specifically the cleaner head, a connecting yoke, part of the upright body of the cleaner, and the wheels.
Figure 9:
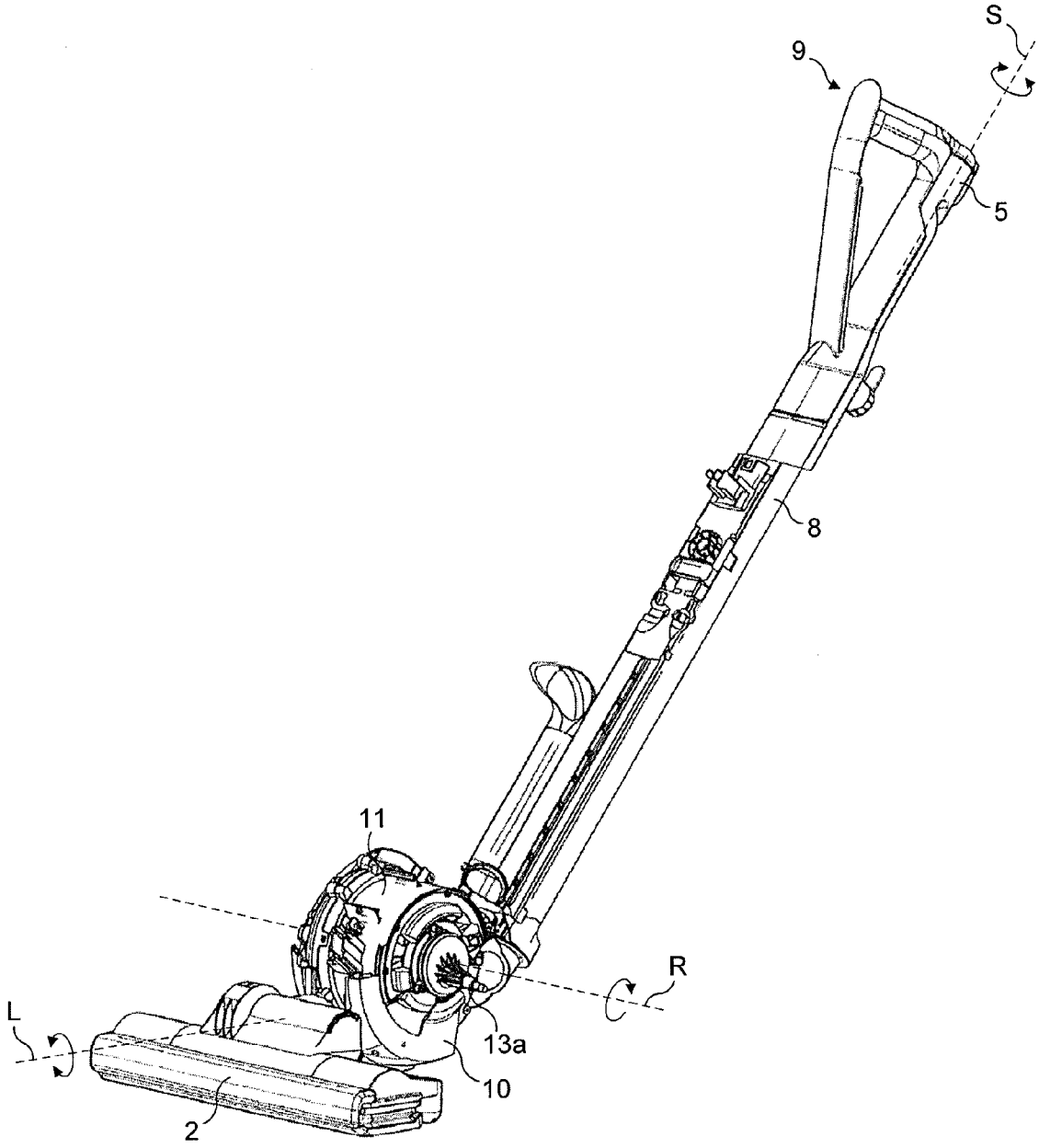
FIG. 9 is a perspective view showing the various parts in FIG. 9 in their assembled configuration, but omitting the wheels.
Figure 10:
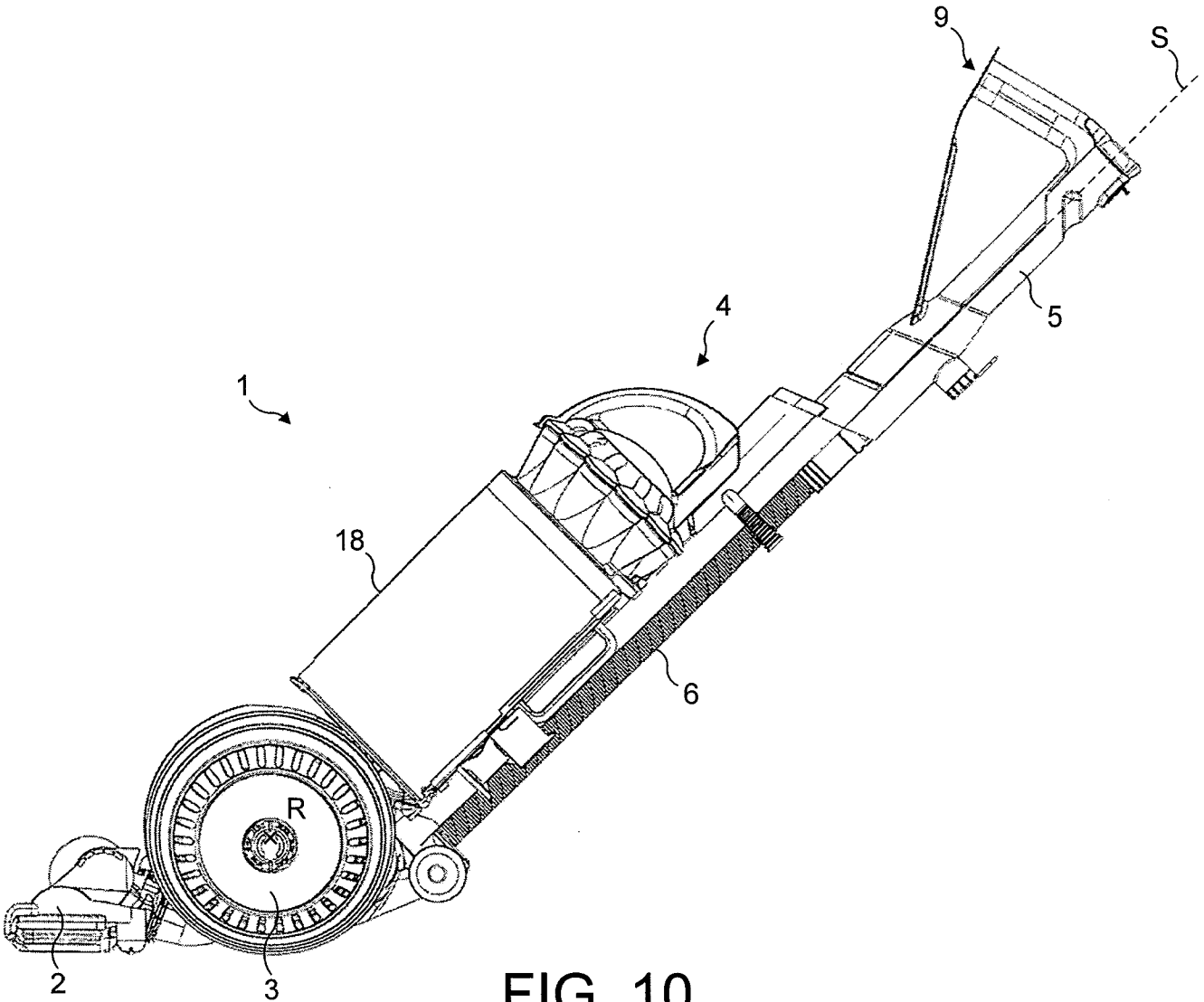
FIG. 10 is a side view illustrating the upright vacuum cleaner shown in FIG. 3 when it is in a reclined position for use in an upright cleaning mode.

The upright body 4 is mechanically coupled to the cleaner head 2 for reclining movement relative to the cleaner head 2 about a Recline Axis R which extends through the wheels 3. This reclining movement of the upright body 4 is made possible by a coupling yoke 10, shown in FIGS. 8 and 9. The coupling yoke 10 connects a cylindrical motor bucket 11 at the lower end of the upright body 4 to the rear of the cleaner head 2. The motor bucket 11 is arranged laterally with its longitudinal axis extending along the Recline Axis R and is rotatably mounted between the arms 12 and 13 of a forked rear section of the yoke 10 for relative rotation about the Recline Axis R. The front part of the yoke 10 in turn connects to the rear of the cleaner head 2 and the wheels 3 are mounted on a pair of stub axles 12*a*, 13*a* provided on the outside of the arms 12, 13. The wheels 3 and the cleaner head 2 thus effectively form a "tripod" supporting base for the motor bucket 11; the motor bucket 11 in turn supports the rest of the upright body 4 for reclining movement about the Recline Axis R, relative to the wheels 3 and the cleaner head 2, as illustrated in FIGS. 9 and 10.

An inlet duct 14 is fluidly coupled to the cyclone pack 7 (FIGS. 4 and 5). A changeover valve 15 (FIG. 6) selectively couples the inlet duct 14 either to a head duct 16 which is connected to the suction inlet on the cleaner head 2, so that in use the motor-driven fan draws dirt-laden air in through the cleaner head 2, or to a wand duct 17 which is connected to the suction inlet at the end of the wand 5, so that the motor-driven fan instead draws dirt-laden air in through the wand 5.

The head duct 16 and wand duct 17 are conveniently arranged inside the interior volume of the wheels 3 to limit the amount of ducting which is visible on the outside of the cleaner 1, but this is not essential and an outboard ducting scheme could equally be used.

In use, the dirt-laden air passing through the inlet duct 14 enters the cyclone pack 7 through a tangential inlet 7*a*. The majority of the dust is then separated from the air-stream in conventional manner inside the cyclone pack 7 by a series of cyclones, before eventually being deposited in a dust-collecting bin 18 forming part of the cyclone pack 7. The relatively clean air is subsequently exhausted downwardly through an outlet in the base of the cyclone pack 7, where it passes through the motor bucket 11 and then out through exhaust holes 3*a* in one of the wheels 3. Pre- and post-motor filters (not shown) are provided inside the cyclone pack 7 and the interior volume of the wheels 3, respectively, for removing very fine particulates from the airflow before it is exhausted back to atmosphere. When the dust collecting bin 18 is full, the entire cyclone pack 7 can be released by means of a catch 28 and the bin 18 can subsequently be emptied in conventional manner.

The cleaner 1 has two modes of operation: a normal "upright" mode used primarily for cleaning a floor surface, and a "cylinder" mode used primarily for cleaning above the level of the floor surface.

In the "cylinder" mode, the changeover valve 15 couples the inlet duct 14 to the wand duct 17, so that the motor-driven fan operates to draw dust-laden air in through the wand 5, with the intention that the wand 5 can be released and manipulated by the user to clean above the level of a floor surface, somewhat in the manner of a so-called "cylinder" (or "canister") cleaner. The stretch hose 6 increases the useful reach of the wand 5; the wand 5 can thus be used for example in order to reach the upper corner of a room, or possibly the top of a flight of stairs depending upon the stretch ratio for the hose 6.

During use of the cleaner 1 in the "cylinder" mode, the cleaner 1 is kept in the fully upright position, shown in FIG. 7, with the upright body 4 extending substantially vertically. A stand 19 is provided which engages the floor behind the wheels 3 in order to stabilize the cleaner 1 in this fully upright position (see also FIGS. 3 to 6).

In the normal "upright" mode, the changeover valve 15 couples the inlet duct 14 to the head duct 16, so that the motor-driven fan operates instead to draw dust-laden air in through the cleaner head 2. To use the cleaner 1 in this mode, the user grasps the handle 9 and then reclines the upright body 4 relative to the cleaner head 2 (see FIG. 10); the user can then conveniently roll the cleaner head 2 together with the rest of the cleaner 1 across the floor, on the wheels 3. The stand 19 is raised in the upright cleaning mode, so that the stand 19 does not hinder smooth rolling of the cleaner 1 across the floor.

The precise configuration and operation of the stand 19 and changeover valve 15 is not relevant to the present invention: any suitable configuration may be used. For example, the stand 19 may incorporate a semi- or fully-automatic mechanism for raising and lowering the stand 19, which may be actuated by reclining the upright body 4 and/or which may be linked to the changeover valve 15, so that the stand 19 and the changeover valve 15 move in co-ordination with one another.

The cleaner 1 can be steered across the floor in the upright mode simply by using the handle 9 to rotate the entire upright body 4 about a longitudinal axis S, running up the spine 8 (FIGS. 9 and 10), such that the hemispherical wheels 3 are effectively banked to the left or the right as appropriate. The rotational movement of the upright body 4 about the axis S is transferred through the motor bucket 11 to the wheels 3 via the yoke 10 (see FIG. 9). In order to prevent corresponding banked movement of the cleaner head 2, which is also connected to the yoke 10, the cleaner head 2 is rotatably connected to the front part of the yoke 10 for relative rotation about a Self-Level Axis, L. Thus, as the wheels 3 and yoke 10 are banked, the cleaner head 2 is free to counter-rotate under its own weight about the axis L. This counter-rotating movement of the cleaner head 2 about the axis L combines with the "hinging" action of the cleaner head 2 about the axis R to ensure that the cleaner head 2 turns to the left or right in plane-parallel contact with the floor as the wheels 3 are banked from left to right. The cleaner head 2 can thus be maintained in contact with the floor surface as the cleaner 1 is steered to the left and right.

Figure 11A:
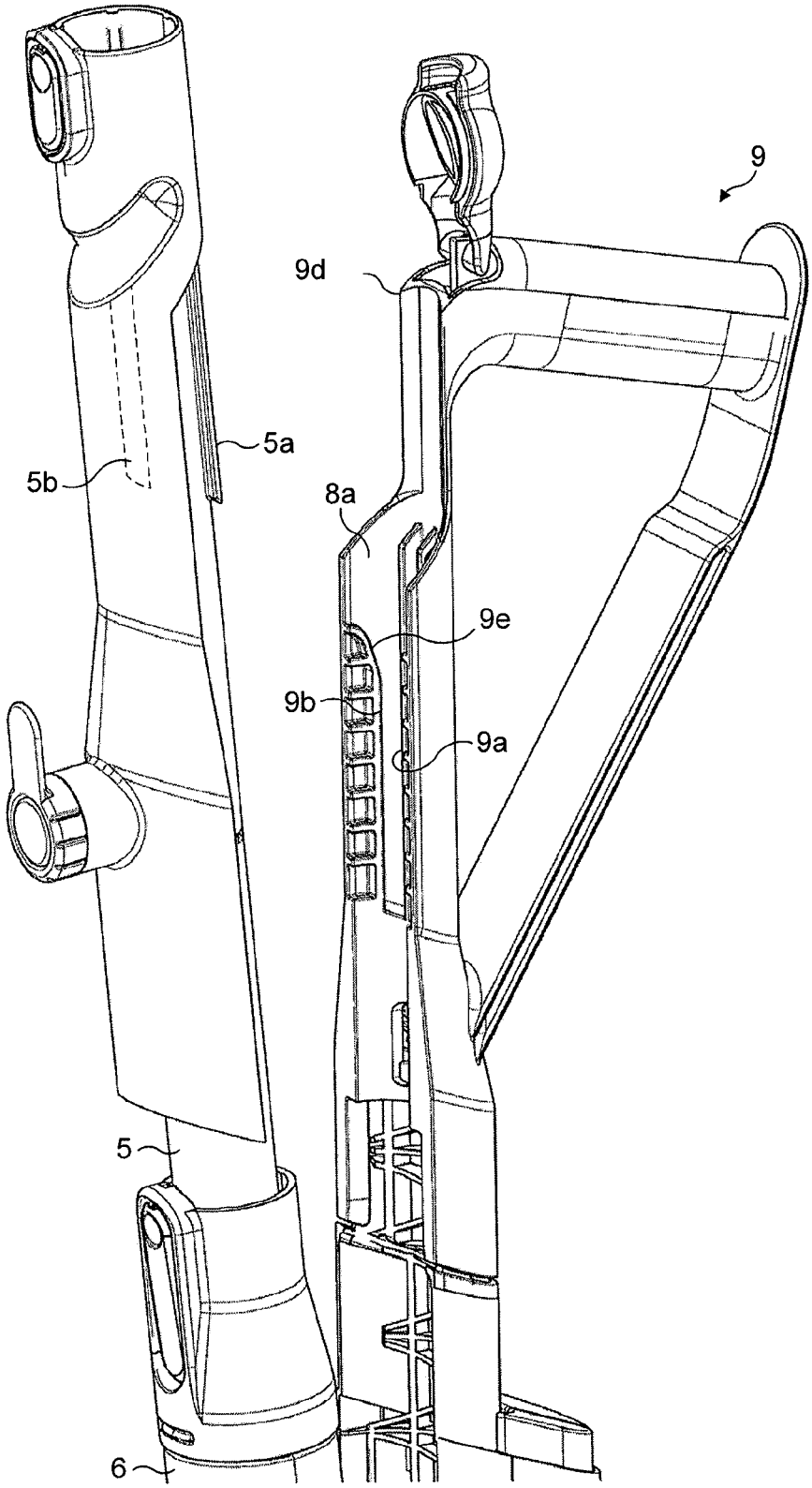
FIGS. 11*a*-11*c* are schematic perspective views of the upper part of the cleaner shown in FIG. 3, illustrating how the upper part of the wand is attached to the cleaner when the wand is in a stowed position.
Figure 11B:
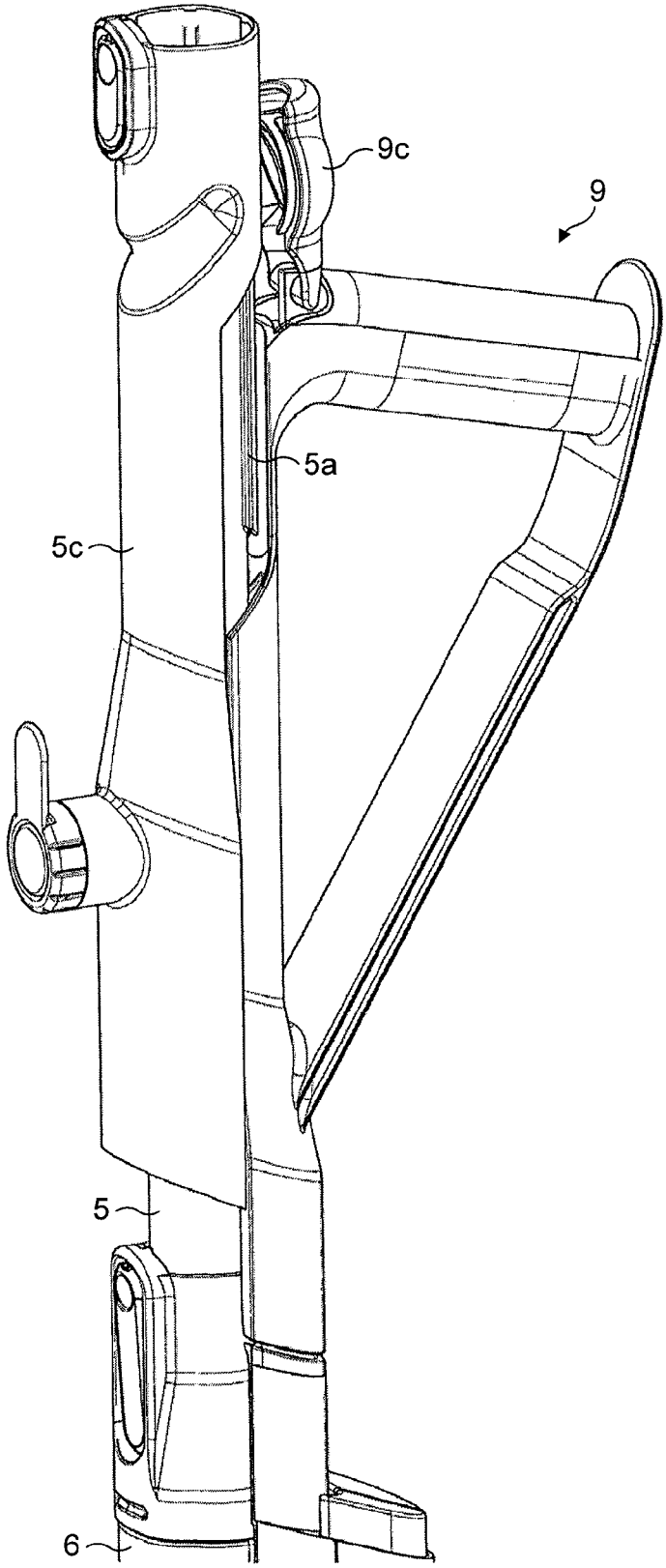
Figure 11C:
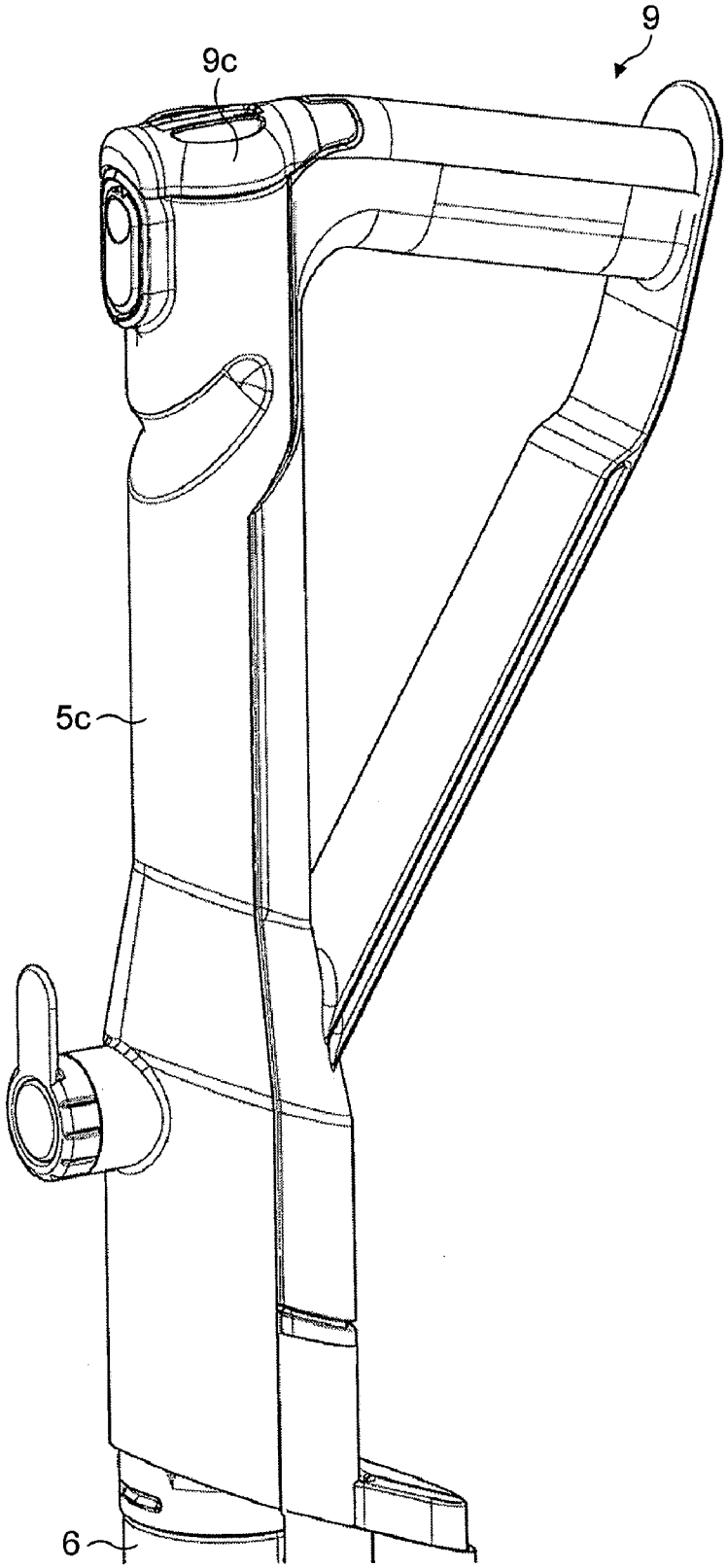

During use of the cleaner 1 in the upright mode, the wand 5 is kept in the stowed position on-board the cleaner 1, with the hose 6 and the wand 5 sitting in the recess 8*a* in the spine 8 and extending along the axis S. The relatively deep nature of the recess 8*a* advantageously accommodates the wand 5 in a space-efficient stowed position, but it also tends significantly to reduce the torsional and flexural stiffness of the spine 8. This can particularly be a problem if the spine 8 is plastic. In order to offset this reduction in stiffness, the wand 5 is stowed on the cleaner 1 so that it acts structurally to brace the handle 9 to the motor bucket 11, as follows:

Referring firstly to FIGS. 11*a* to 11*c*, the upper end of the wand 5 engages a rear portion of the handle 9 in a close sliding fit, which constrains a corresponding upper portion of the wand 5 relative to the handle 9. The wand 5 is fitted to the handle 9 by means of a pair of longitudinal engaging ribs 5*a*, 5*b* which engage with corresponding longitudinal ribs 9*a*, 9*b* provided in the recess 8*a* on the rear of the handle 9. Only the ribs 5*a*, 9*b* are clearly visible in FIG. 11*a*. In order to engage the respective ribs 5*a*, 9*a* and 5*b*, 9*b* the wand 5 is firstly located in the recess 8*a* and almost fully retracted inside the hose 6, with the ribs 5*a*, 5*b* positioned immediately above the respective ribs 9*a*, 9*b* as shown in FIG. 11*b*. The wand 5 can then be slid downwardly to its fully retracted position such that the ribs 5*a*, 5*b* locate in front of the ribs 9*a*, 9*b* firmly to secure the wand 5 to the handle 9, as shown in FIG. 11*c*. In order to ease engagement with the ribs 5*a*, 5*b*, each of the ribs 9*a*, 9*b* terminates at its upper end in a ramp portion (only one of which is shown, ramp portion 9*e*) for guiding the ribs 5*a*, 5*b* in front of the ribs 9*a*, 9*b*.

Although in the case of cleaner 1, the upper part of the wand 5 engages the handle 9 part-way down from the uppermost part 9*d* of the handle 9, the wand 5 may additionally or alternatively engage the handle in the region of the uppermost part 9*d* of the handle as required to reduce twisting of the handle 9. Similarly, if the handle 9 was substantially stiffer than the spine 8, the wand 5 may engage the rear of the spine 8 immediately below the base of the handle 9 while still effectively bracing the handle to the motor bucket 11.

The upper end of the wand 5 is provided with a shroud 5*c* which is contoured to provide a more "finished" appearance to the handle 9 when the wand 5 is in the stowed position shown in FIG. 11*c*. A hinged cap 9*c* is also provided at the top of the handle 9.

Figure 6:
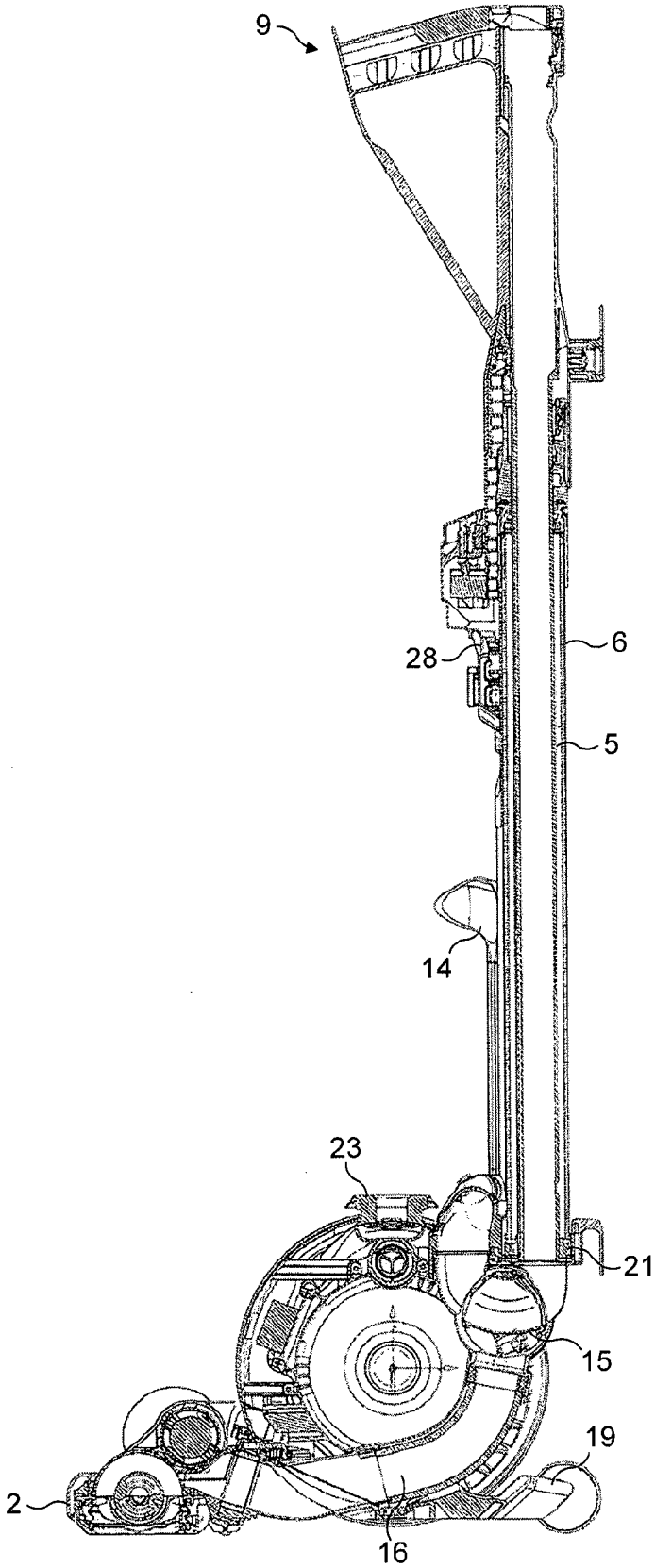
FIG. 6 is a cross-sectional side view of the upright vacuum cleaner shown in FIG. 3, with the cyclone pack removed.
Figure 7:
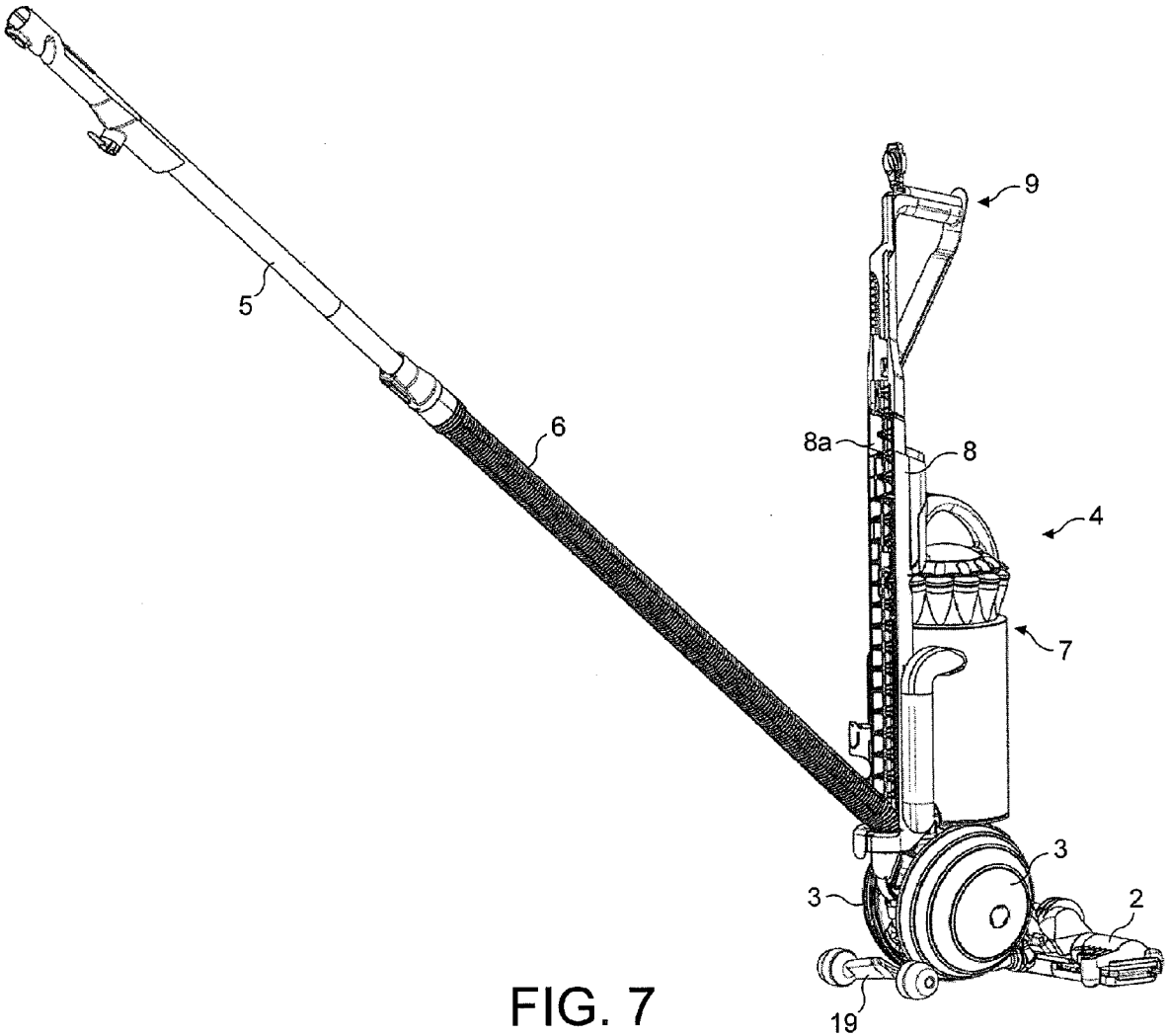
FIG. 7 is a rear perspective view of the upright vacuum cleaner shown in FIG. 3, illustrating release of a wand and hose assembly.
Figure 12:
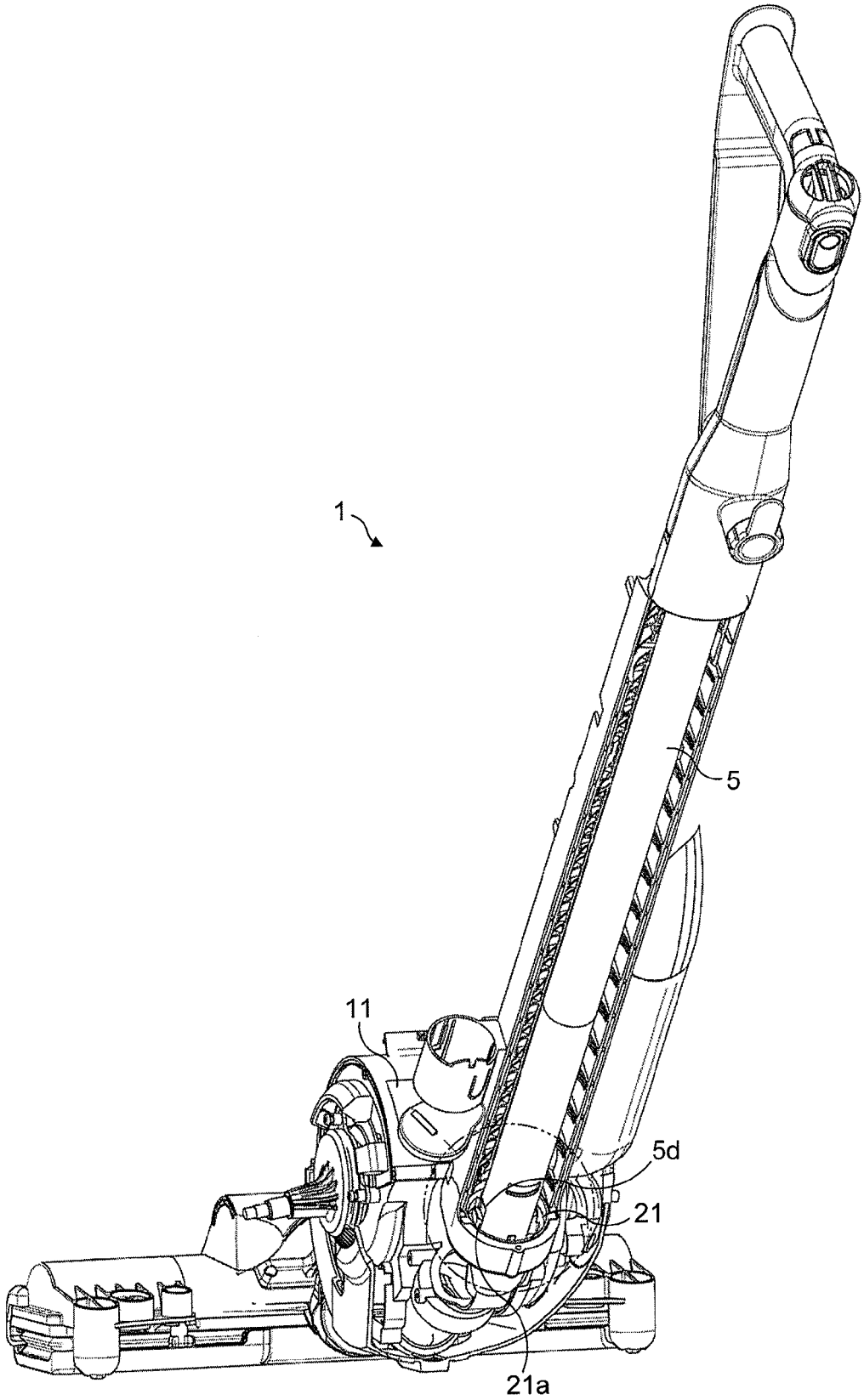
FIG. 12 is a rear perspective view of the cleaner shown in FIG. 3, with the cyclone pack and hose omitted.
Figure 13:
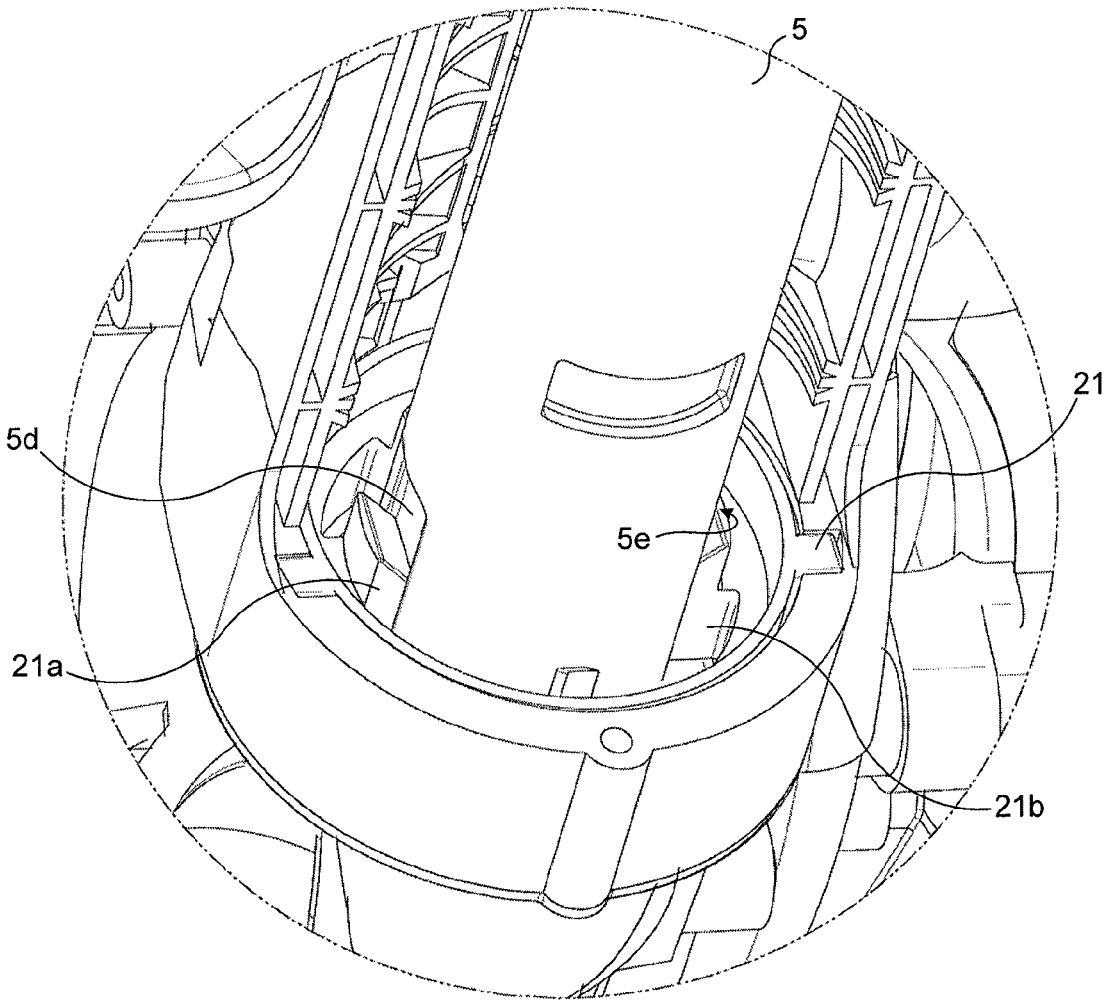
FIG. 13 is a close up view of part of FIG. 13, illustrating engagement of the wand with a transmission collar.

Referring now to FIGS. 6, 12 and 13, a transmission collar 21 is provided on the upright body 4, at the lower end of the hose 6 (the hose 6 has been omitted in FIGS. 12 and 13, for clarity). The transmission collar 21 is rigidly connected to the motor bucket 11 and is provided with a pair of diametrically opposed keying elements 21*a*, 21*b*, best viewed in FIG. 13. The keying elements 21*a*, 21*b* are configured to key into corresponding, blind key-ways 5*d*, 5*e* formed on the lower end of the wand 5 when the wand 5 is in the fully retracted position inside the hose 6. In this position, the keying elements 21*a*, 21*b* constrain the lower end of the wand 5 relative to the transmission collar 21, and hence relative to the motor bucket 11.

The ribs 5*a*, 5*b* are orientated relative to the keyways 21*a*, 21*b* such that, as the wand 5 is retracted inside the hose 6 in order to engage the ribs 5*a*, 5*b* with the ribs 9*a*, 9*b*, the key elements 5*c*, 5*d* are aligned for engagement with the keying elements 21*a*, 21*b* on the transmission collar 21. Thus, when the wand 5 is stowed on-board the cleaner 1 an upper portion of the wand 5 is constrained relative to the handle 9 and a lower portion of the wand 5 is constrained relative to the motor bucket 11 (in this case via the transmission collar 21). The wand 5 itself is substantially rigid and less flexible than the spine 8. Consequently, the wand 5 acts as a structural brace between the handle 9 and the motor bucket 11, significantly reducing general flexing of the spine 8, for example during use of the cleaner 1 in the upright cleaning mode.

The keying action of the transmission collar 21 acts to prevent (or at least significantly limit) relative rotation of the wand 5 and the motor bucket 11 about the longitudinal axis of the wand 5. Similarly, the ribs 5*a*, 5*b*, 9*a*, 9*b* act to prevent (or at least significantly limit) relative rotation of the wand 5 and the handle 9 about the longitudinal axis of the wand 5. The wand 5 thus additionally forms a structural component of the steering mechanism for the cleaner 1, acting to transmit a manual steering torque along its longitudinal axis from the handle 9 to the motor bucket 11.

The wand 5 can conveniently be released from its on-board stowage position simply by sliding the wand 5 upwardly inside the hose 6 until the ribs 5*a*, 5*b* disengage the ribs 9*a*, 9*b* and the key-ways 5*c*, 5*d* slide out of engagement with the keying elements 21*a*, 21*b* on the transmission collar 21. The structural function of the wand 5 does not therefore impede easy release of the wand 5.

The transmission collar 21 rigidly constrains the wand 5 relative to the motor bucket 11 for co-rotation about the axis S. The ribs 5*a*, 5*b*, 9*a*, 9*b* provide a slightly more flexible constraint on the wand 5, allowing a very limited degree of relative rotation of the wand 5 and the handle 9 about the axis S. If this very small relative rotation of the wand 5 and the handle 9 is considered unsatisfactory, the ribs 5*a*, 5*b*, 9*a*, 9*b* could be replaced with another arrangement so that the wand 5 is also rigidly constrained relative to the handle 9. For example, the spine may incorporate some sort of releasable clamping arrangement for rigidly clamping the wand 5 to the spine 8 or the handle 9.

In any event, it is not essential that the wand is constrained using ribs and/or a transmission collar; other constraining arrangements may be used as appropriate.

It is envisaged that any undesirable flexibility between the handle and a lower part of an upright cleaning appliance can be significantly reduced or eliminated by using the wand structurally to brace the handle to the lower part of the cleaner. However, where the handle is mounted on a spine of the cleaning appliance, the spine may additionally be braced by the dust-collecting bin, or a larger, removable component incorporating the dust-collecting bin.

For example, in the case of the cleaner 1 the spine 8 is additionally braced to the motor bucket 11 by the cyclone pack 7 (which incorporates the dust-collecting bin 18). This is achieved by ensuring that, when the cyclone pack 7 is mounted on-board the cleaner 1, the cyclone pack 7 is fixedly constrained relative both to the spine 8 and to the motor bucket 11.

The cyclone pack 7 is fixedly constrained relative to the spine 8 by appropriately configuring the release catch 28 so that, when the release catch is engaged, the catch rigidly locks the cyclone pack 7 to the spine 8 and, in particular, there is none of the sliding movement associated with the catch arrangement described in GB2416483.

Figure 14:
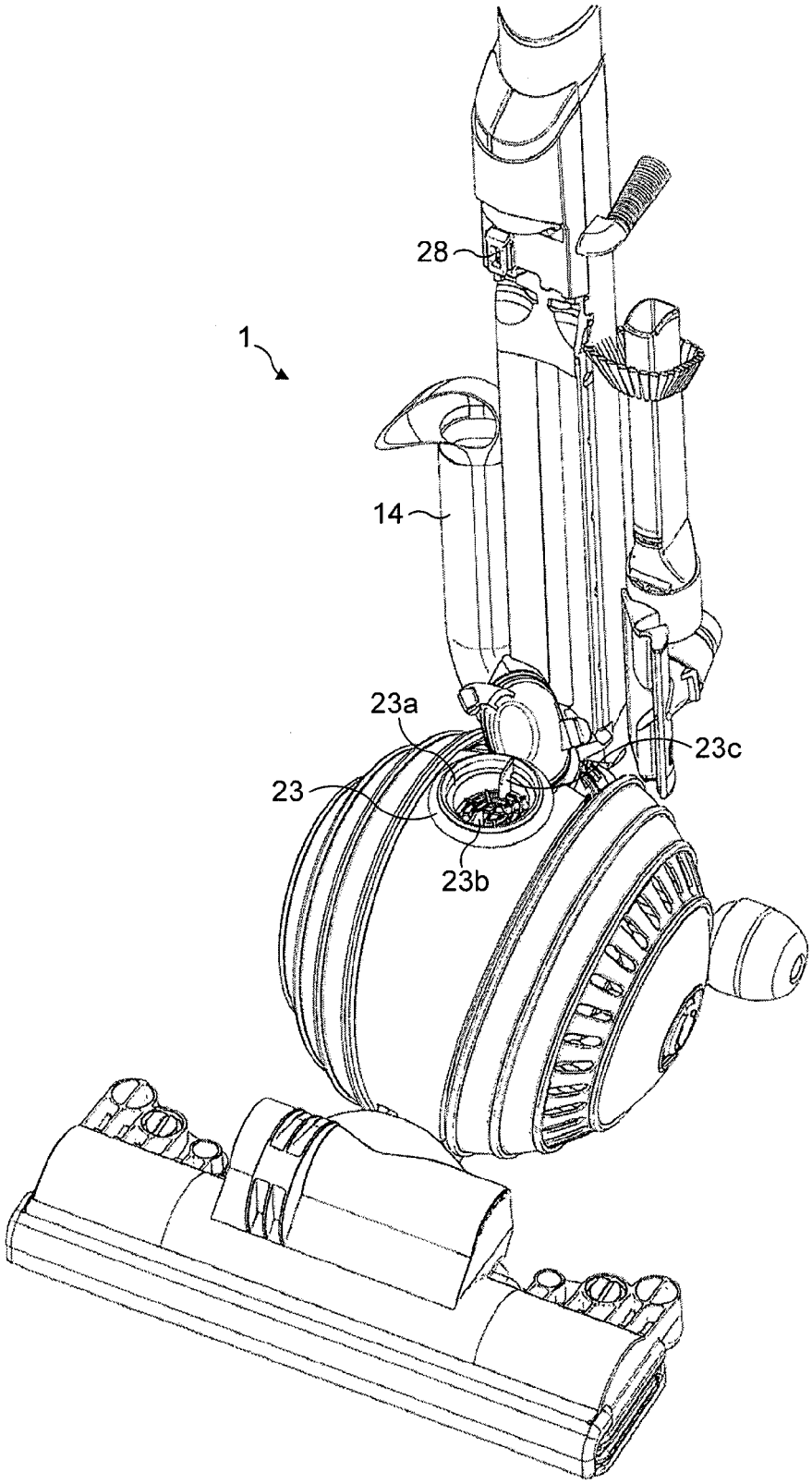
FIG. 14 is a further perspective view of part of the cleaner shown in FIG. 3, again with the cyclone pack removed.

Referring FIGS. 6 and 14, the cyclone pack 7 is fixedly constrained relative to the motor bucket 11 by a circular outlet duct (not visible) provided on the underside of the base of the cyclone pack 7. This circular outlet duct is received in a close sliding fit inside a motor air inlet duct 23 rigidly connected to the motor bucket 11 to form a through-duct linking the cyclone pack 7 to the motor inside the motor bucket 11. The inner diameter of the motor air inlet duct 23 is rebated at the top to provide a shoulder 23*a* which abuts against the underside of the circular outlet duct on the base of the cyclone pack 7. The circular outlet duct thus acts as a mounting spigot and the cyclone pack 7 is effectively supported indirectly by the motor bucket 11. The motor air inlet duct 23 is additionally provided with a pair of diametrically opposed key members 23*b*, 23*c* which engage with corresponding notches cut into the underside of the circular outlet duct on the cyclone pack 7 in order to key the cyclone pack 7 (indirectly) to the mounting bucket 11. A sealing gasket (not shown) may be provided between the outlet duct on the cyclone pack and the motor inlet duct 23.

The handle 9 is configured so that it is comfortable for the user, particularly when the user is rotating the handle 9 about a longitudinal axis of the upright body 4 in order to steer the cleaner 1.

The handle 9 incorporates a stem portion 24, which in this case forms a co-axial extension of the spine 8, and a forward-extending handgrip portion 25.

The provision of the forward-extending handgrip portion 25 allows a user conveniently to rotate the handle 9 about the longitudinal axis of the wand 5, thus effectively transmitting steering torque from the handle 9 along the axis S to the motor bucket 11 (via the wand 5).

Figure 16:
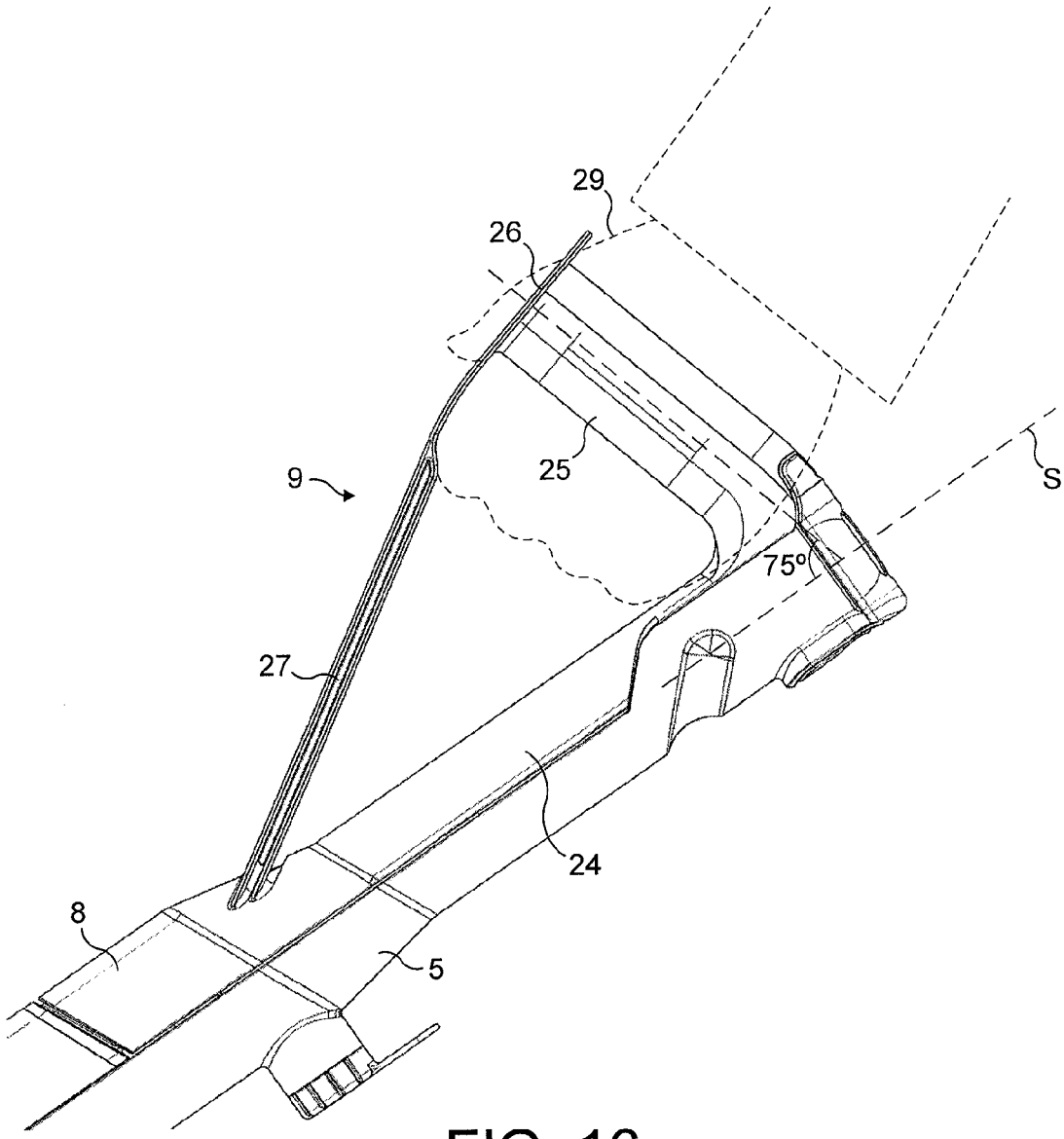
FIG. 16 is a perspective view illustrating how a user typically holds the handle during use of the cleaner in an upright cleaning mode.

The heaviest component of the upright body 4 is the motor, which is housed with the fan inside the motor bucket 11. In order to minimize the moment arm of the center of mass of the upright body 4 about the Recline Axis, R the motor bucket 11 is arranged co-axially with the Recline Axis, R, as illustrated in FIG. 9. Nevertheless, the center of mass of the upright body 4 will tend to be located somewhere above the Recline Axis, R, and indeed this is preferable in order to promote a free recline of the upright body 4. The weight of the upright body 4 thus exerts a torque about the Recline Axis, R which tends to pull the forward-extending handgrip portion 25 down towards the user. In order to prevent (or least significantly reduces the chances of) the handgrip portion 25 consequently slipping out through the bottom of a user's grip, the forward end of the handgrip portion 25 is provided with a lateral abutment flange 26, which provides an abutment surface for the top of a user's grip 29, as illustrated in FIG. 16. This reduces the necessary grip pressure required to support the weight of the reclining upright body 4. In addition, it has been found that the abutment flange 26 also provides an effective "torque-bearing" surface for the top of the user's grip, which the user can utilize to increase leverage of the handle 9 about the longitudinal axis of the wand 5 simply by butting his or her grip up against the underside of the flange 26 as he or she rotates the handle 9.

The handgrip portion 25 is straight. A straight handgrip portion has been found to provide better leverage for the user when rotating the handle 9 about the longitudinal axis of the wand 5, as compared to the conventional curved handgrip portion commonly provided on upright vacuum cleaners, where the tendency is for the user's hand to roll "over the top" of the curved handgrip as the handle is rotated about a longitudinal axis of the upright body of the cleaner. The straight handgrip portion 25 appears in particular to provide good leverage for the user when it is used in combination with the abutment flange 26.

Figure 15:
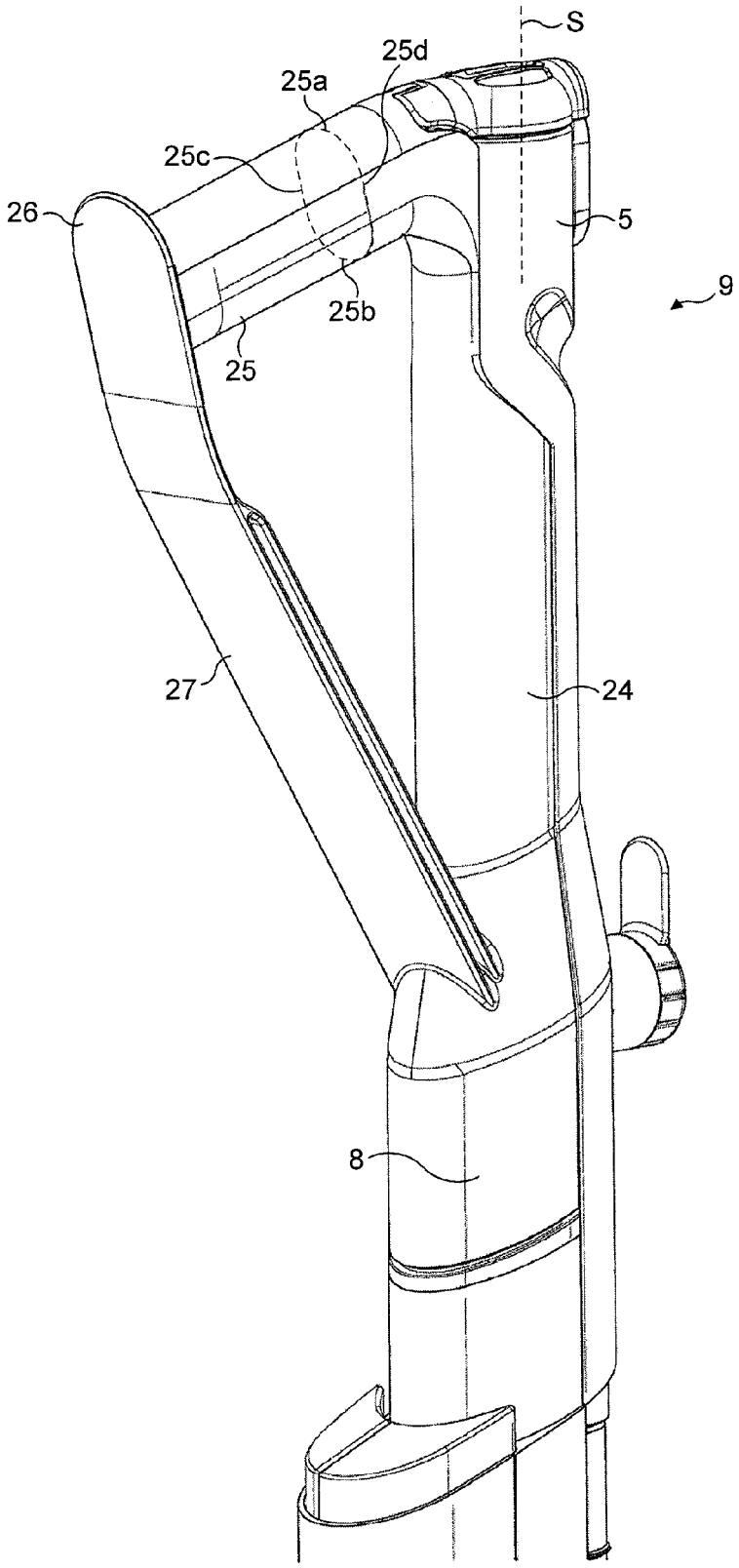
FIG. 15 is a perspective view showing the handle of the cleaner shown in FIG. 3.

The handgrip portion 25 has a racetrack profile when viewed in cross-section, comprising a curved top surface 25*a*, a curved underside 25*b* and opposing straight sides 25*c* and 25*d* (FIG. 15). This racetrack cross-profile has been found to offer a particularly comfortable grip for the user, especially when combined with the straight longitudinal profile of the handgrip portion 25.

The handgrip portion 25 extends at an angle of 75 degrees to the longitudinal axis of the wand 5 (which represents an operative steering axis for the upright body 4). In this case, the spine 8 and stem portion 24 each run parallel to the wand 5, and the handgrip portion 25 thus also extends at an angle of 75 degrees to the spine 8 and the stem portion 24 (FIG. 16).

A straight, flat bracing strut 27 extends downwardly and backwardly from the lower edge of the flange 26 to the base of the stem portion 24 in order to brace the handgrip portion 25 to the stem portion 24 and increase the rigidity of the handle 9.

The invention claimed is:

1. An upright cleaning appliance comprising: a handle for maneuvering the appliance across a floor, the handle being secured on a reclining upright body of the appliance for rotation about a longitudinal axis of the upright body, the handle comprising a forward-extending handgrip portion which terminates in an abutment flange.

2. An upright cleaning appliance according to claim 1, wherein the handgrip is straight.

3. An upright cleaning appliance according to claim 1, wherein the cross-sectional profile of the handgrip portion is a racetrack profile.

4. An upright cleaning appliance according to claim 1, wherein the handgrip portion is angled at 70-80 degrees to the longitudinal axis of the upright body.

5. An upright cleaning appliance according to claim 1, wherein the abutment flange extends perpendicular to the handgrip portion.

6. An upright cleaning appliance according to claim 1, wherein the handle incorporates a bracing strut connecting the abutment flange to the base of the handle.

7. An upright cleaning appliance according to claim 1, wherein the handle forms part of a steering mechanism for steering the cleaner across the floor, the handle being connected to an intermediate part of the steering mechanism operable for co-rotation with the handle about said longitudinal axis of the upright body.

8. An upright cleaning appliance according to any of claims 1 to 7, in the form of an upright vacuum cleaner.

9. A handle for use in an upright cleaning appliance, the handle comprising the features of the handle recited in any of claims 1 to 6.

* * * * *